US005079780A

United States Patent [19]

Coombs et al.

[11] Patent Number: 5,079,780

[45] Date of Patent: Jan. 14, 1992

[54] CHINSTRAP ACTIVATED HEAD ADJUSTMENT ASSEMBLY FOR A PROTECTIVE HELMET ASSEMBLY

[75] Inventors: Christopher E. Coombs, Boonton; Adolfo A. Ferreira, Middlesex; Scott J. Miller, Little Falls, all of N.J.

[73] Assignee: Cairns & Brother, Inc., Clifton, N.J.

[21] Appl. No.: 579,840

[22] Filed: Sep. 10, 1990

Related U.S. Application Data

[63] Continuation of Ser. No. 261,920, Oct. 24, 1988.

[51] Int. Cl.[5] ..... A42B 3/08

[52] U.S. Cl. ..... 2/420

[58] Field of Search ..... 24/170, 191; 2/5, 6, 2/411, 418, 419, 420, 421

[56] References Cited

U.S. PATENT DOCUMENTS

| | | | |
|---|---|---|---|
| 2,814,043 | 11/1957 | Alesi | 2/421 |
| 2,846,683 | 8/1958 | Dye et al. | 2/421 |
| 2,926,355 | 3/1960 | Finken | 2/418 |
| 3,110,900 | 11/1963 | Crowdes, Jr. | 2/419 |
| 4,000,520 | 1/1977 | Svendsen et al. | 2/418 |
| 4,075,714 | 2/1978 | Ryder et al. | 2/6 |
| 4,703,879 | 11/1987 | Kastendieck et al. | 2/6 X |
| 4,741,054 | 5/1988 | Mattes | 2/421 |
| 4,843,688 | 7/1989 | Ikeda | 24/170 |

FOREIGN PATENT DOCUMENTS

| | | | |
|---|---|---|---|
| 1096070 | 12/1954 | France | 2/421 |
| 998695 | 7/1965 | United Kingdom | 2/420 |
| 2202729 | 10/1988 | United Kingdom | 2/411 |

*Primary Examiner*—Werner H. Schroeder
*Assistant Examiner*—John J. Calvert
*Attorney, Agent, or Firm*—Louis E. Marn

[57] ABSTRACT

A protective helmet assembly including an outer impact shell and an inner impact attenuation liner assembly wherein the inner liner assembly includes an adjustable headband assembly comprised of a front headband member and a rear spring-loaded headband member under the control of a chinstrap into a fitted configuration about the head of the user by a clip assembly. The inner impact attenuation liner assembly is mounted within the outer impact shell to separate therefrom under predetermined load conditions.

16 Claims, 6 Drawing Sheets

CHINSTRAP ACTIVATED HEAD ADJUSTMENT ASSEMBLY FOR A PROTECTIVE HELMET ASSEMBLY

This is a continuation of application Ser. No. 07/261,920, filed Oct. 24, 1988.

BACKGROUND OF THE INVENTION (a) Field of the Invention

This application relates to a safety helmet assembly, such as a fireman's helmet, and more particularly to an improved head band and chinstrap assembly for positioning, adjusting and securing the protective helmet assembly onto the head of the user.

(b) Description of the Prior Art

For the longest time, firefighters and other protective helmet users were given their protective helmets, accomplished an adjustment to make them feel comfortable, and then wore them exclusively, with no trading around or passing off of one person's helmet to another. While this is still virtually true in the municipal firefighting business, and with individual hard-hat users who own and maintain their own head protection, it is not typical in industrial fire brigades where the equipment, head to toe, is shared between several different people without really much thought for proper adjustment, or perfect fit. Because of the time pressure, and the need for universal fit, commonly the helmets are worn with their suspensions wide open, very loosely fitting. When a user wears such a helmet, he depends entirely on the chinstrap to hold the helmet on his head, and this is only modestly effective in retaining the helmet on the user's head when he is in precarious or exposed circumstances.

Currently, the protective helmet assemblies are primarily dominated by head adjustment systems that are individually accomplished by each wearer/owner. The most popular version of such fixed adjustment suspension system employs a post and hole, single adjustment, with the adjustment accomplished at the sides or at the rear. A ratchet system and alternately a breakaway feature allow more flexibility and adjustability on a quick-release basis, should the wearer change the protective equipment he is wearing under the suspension system, and needs to change the sizing to fit the helmet properly on his head. Such breakaway feature is a fixed one, however, and does not refit the helmet, but simply opens it up generally, allowing for the increase in sizing caused by donning the breathing apparatus face piece, a knit hood, or both.

Such ratchet system has a turning knob that mounts at the rear of the head, under the helmet and suspension system. It is exposed well outside the protective envelope of the helmet, but does provide reasonably comfortable and effective instant adjustment, no matter what kind of equipment layering is going on underneath the head suspension system in the helmet. The ratchet system poses the very present danger of being exposed to direct impact, and focusing impact energies in transferring that impact to the user's head. Any adjustability feature of the ratchet system has been deemed so important with the changes in head sizing caused by donning and doffing the various new layers of protection common to the fire service, that people have decided to overlook the potential danger of "on-ratchet" impact in deference to the importance of proper fit. In addition, in an emergency situation, the complexity of any adjustment mechanism slows down the donning procedure, and if it is too time consuming or inconvenient, will actually not even be used before the wearer exposes himself to circumstances and conditions which might require the proper retention of his helmet on his head.

OBJECTS OF THE INVENTION

It is an object of the present invention to provide an improved protective helmet assembly readily adjustable to the head of the user.

Another object of the present invention is to provide an improved protective helmet assembly readily adjustable in one operation to the head of the user.

Still another object of the present invention is to provide an improved protective helmet assembly capable of facile adjustment to the head of the user regardless of head size.

Yet another object of the present invention is to provide an improved protective helmet assembly permitting of use exchange between users, regardless of head size.

A further object of the present invention to provide an improved protective helmet assembly having a readily replaceable head adjustment suspension system.

A still further object of the present invention is to provide an improved protective helmet assembly.

SUMMARY OF THE INVENTION

These and other objects of the present invention are achieved in a protective helmet assembly including an outer impact shell and an inner impact attenuation liner assembly including an adjustable headband assembly comprised of a front headband member and a rear spring-loaded headband member under the control of a chinstrap into a fitted configuration about the head of the user by a clip assembly. The inner impact attenuation liner assembly is mounted within the outer impact shell to separate therefrom under predetermined load conditions.

BRIEF DESCRIPTION OF THE DRAWING

Further objects and advantages of the present invention will become apparent upon consideration of the detailed disclosure thereof, especially when taken with the accompanying drawings wherein like numerals designate like parts throughout and wherein.

DETAILED DESCRIPTION OF THE INVENTION

Figure 1:
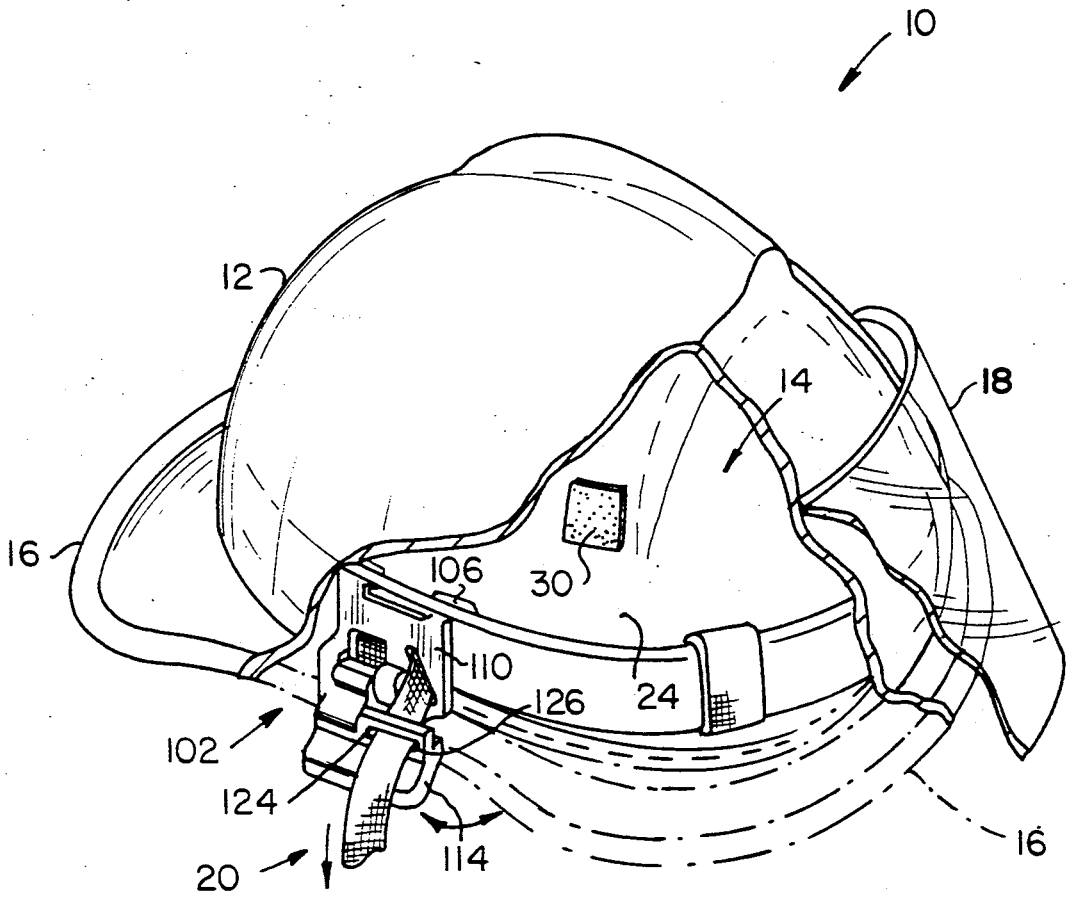
FIG. 1 is an isometric view, partially cut away, of the protective helmet assembly of the present invention.

Referring now to the drawings, there is illustrated in FIG. 1 a profile view of a fireman's protective helmet assembly embodying the present invention, generally indicated as 10, comprised of an outer shell 12 in which is mounted an inner adjustable impact attenuation liner assembly, generally indicated as 14. The outer shell 12 is formed with a brim 16 wider at the back than at the front to shield the back of wearer's neck. A transparent visor 18 is rotatably mounted by mounting assembly (not shown) to the outer shell 12 to be lowered to provide eye protection to the user, such as illustrated in U.S. Pat. No. 4,286,339 assigned to the same assignee as the present invention. A chinstrap assembly, generally indicated as 20, is mounted in an adjustable manner as part of the inner liner assembly 14 as more fully hereinafter described.

Figure 2:
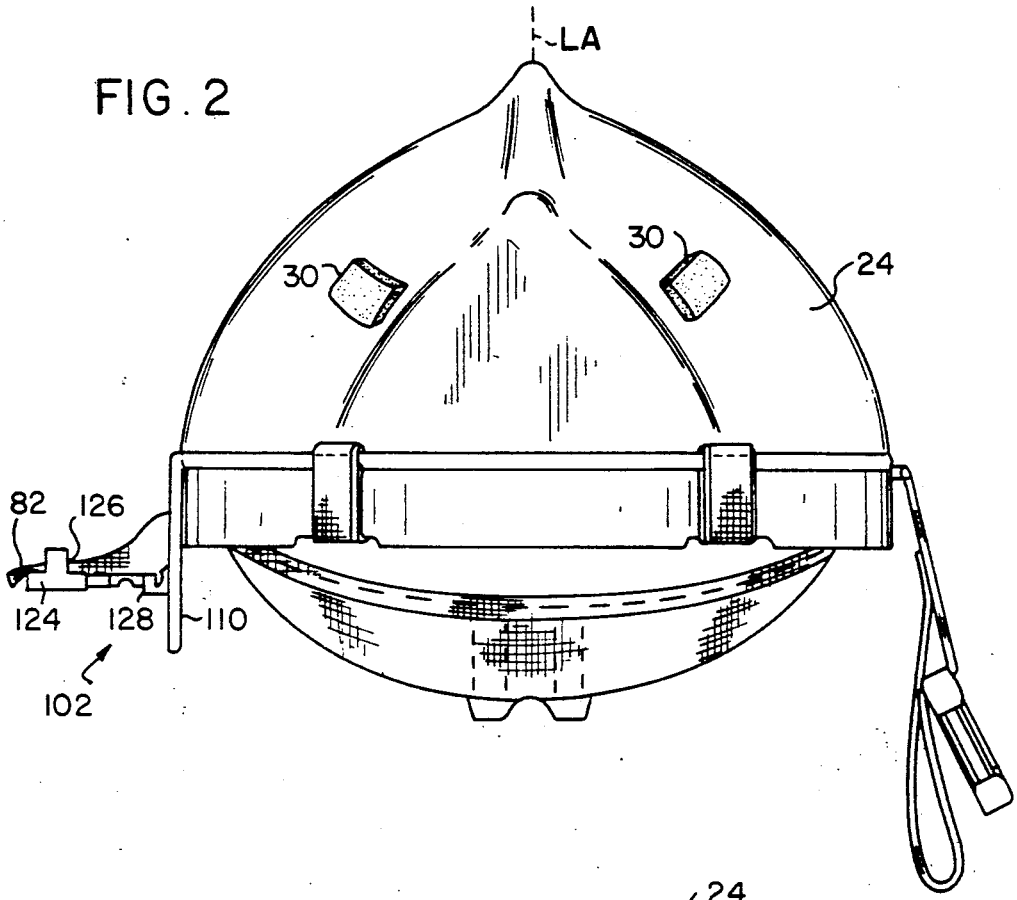
FIG. 2 is a front view of the inner impact attenuation liner assembly of the protective helmet assembly of FIG. 1.
Figure 3:
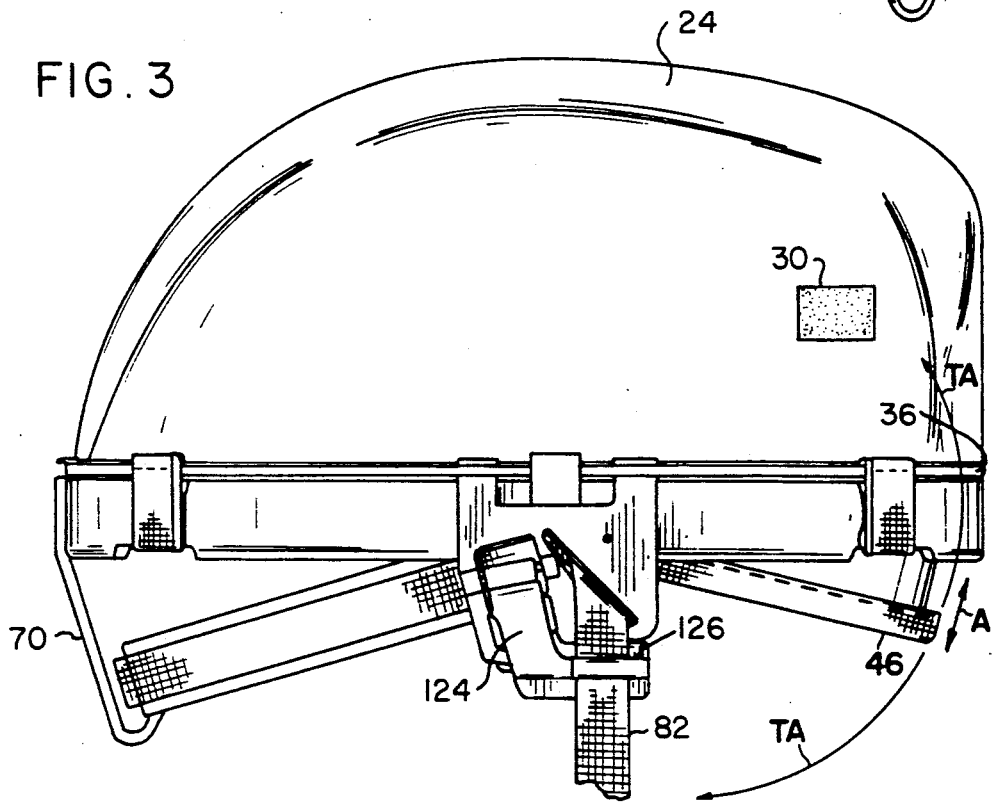
FIG. 3 is a side view of the inner impact attenuation liner assembly of FIG. 2.

The inner impact attenuation liner assembly 14 is positioned within the outer shell 12, referring to FIGS. 2 and 3, and is comprised of a hemi-ovoid-shaped non-resilient foam liner 24 and a cradle, generally indicated as 26, of a plurality of web straps 28 and having a longitudinal axis "LA". The foam liner 24 of the inner liner assembly 14 is frictionally fitted within the outer shell 12. The exterior surface of the foam liner 24 generally corresponds to the interior surface of the outer shell 12. Frictional retention of the foam liner 24 in the outer shell 12 is augmented by the use of cooperating patches of hook and loop fastener material, generally indicated as 30 (one shown), such as that sold under the trademark "Velcro®", reference to FIG. 1.

The foam liner 24 is molded of a non-resilient foam material, such as polyurethane and is chosen to be deformable under high lateral impact conditions to distribute the force of impact over a relatively large area of the head and to absorb energy while deforming to reduce the lateral force transmitted to the head. The interior portion of the foam liner 24 is lined with a thin plastic shell 32 of a rigid plastic material including an annular rim portion 34 of channel cross-section positioned about the annular lower end of the foam liner 24. Each strap 28 is formed of a strong webbing, such as nylon, stitched together at the central apex of the cradle 26 and proceeds from the apex to the rim portion 34. Each strap 28 wraps about the rim portion 34 and proceeds upwardly along the outer surface of the foam liner 24, is wrapped about a tube member 36 inset in a groove 38 formed in the outer surface of the foam liner 24. The loops 40 of the free ends of each of the straps 28 are collected by a drawstring 42 knotted to allow adjustment of the cradle 26 to suit the individual.

The helmet assembly is supported on the wearer's head by a headband assembly, generally indicated as 44, comprised of a front headband member 46, and a rear adjustable headband member 48 positioned on plate members 50 mounted, such as by pin members 52, to the inner liner assembly 14 proximate each side portion thereof. The front headband member 46 is lined with a sweatband 54 and is formed with a perpendicularly-disposed and upwardly extending tab member 56 having a strip of fastening material 58 mounted on an outer surface thereof in axial alignment with a cooperating strip of fastening material 60 vertically mounted to the inner surface of shell 32 disposed within the foam liner 24 in a vertical fore and aft axis of the protective helmet assembly 10. Lateral free ends 62 of the front headband portion 46 is formed with a plurality of holes 64 for adjustably positioning each free end 62 thereof on a pin member 66 formed on each plate member 50 as more fully hereinafter described.

Figure 8:
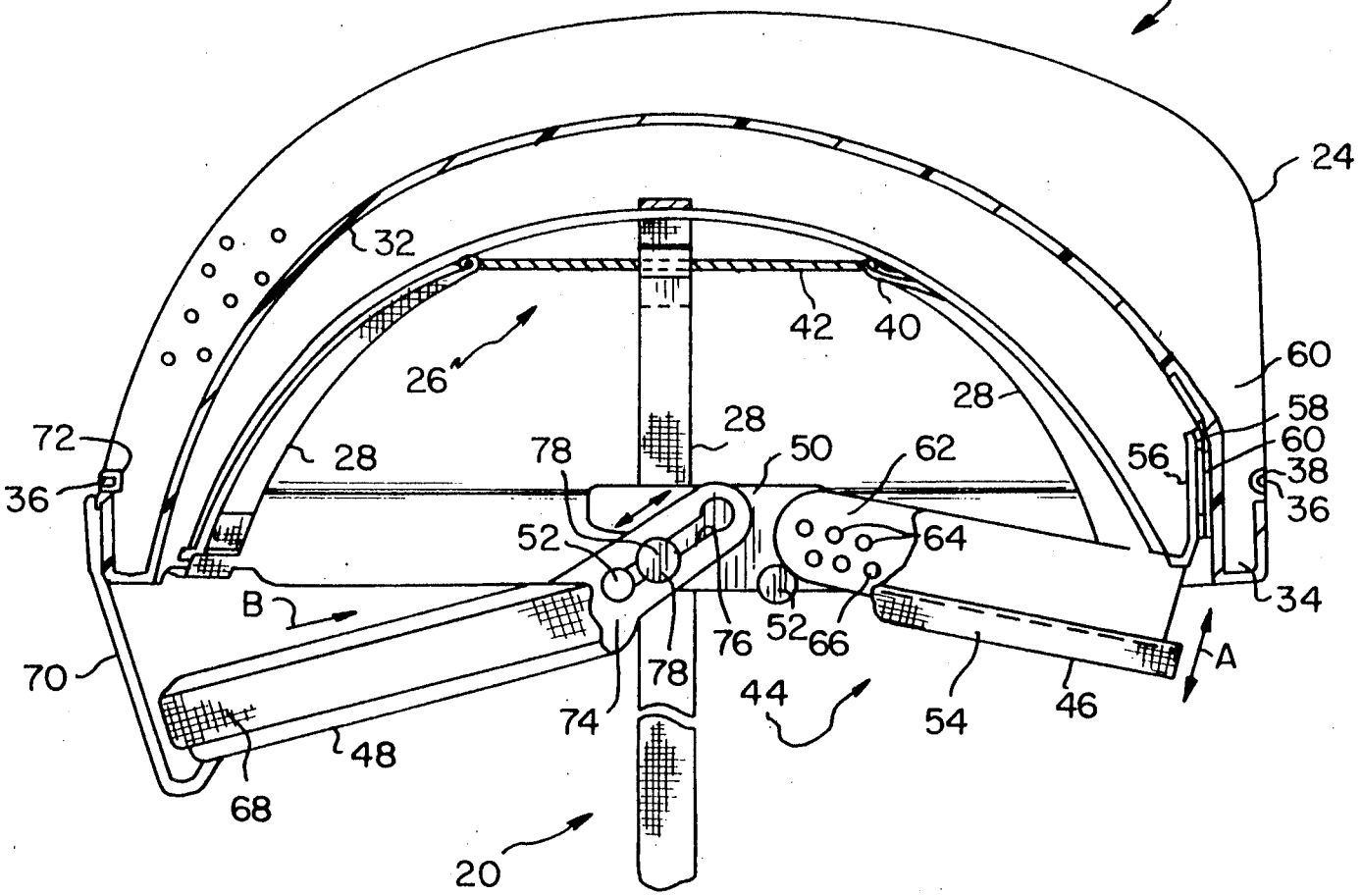
FIG. 8 is a partial cross-sectional view of the protective helmet assembly of the present invention.

The rear adjustable headband member 48 is provided with a sweatband 68 and is formed with an upwardly extending parallel-disposed leg portions 70 disposed along such vertical fore and aft axis with upper end C-shaped portions 72 thereof being mounted behind the tube member 36 above an outer portion of the rim 34. Side free-end portions 74 of the rear adjustable headband member 48 are formed with a slot 76 referring more particularly to FIG. 8, and are slidably mounted to the plate member 50 by a pin member 78 for lateral fore and aft movement with respect to the foam liner member 24, as more fully hereinafter described.

Figure 4:
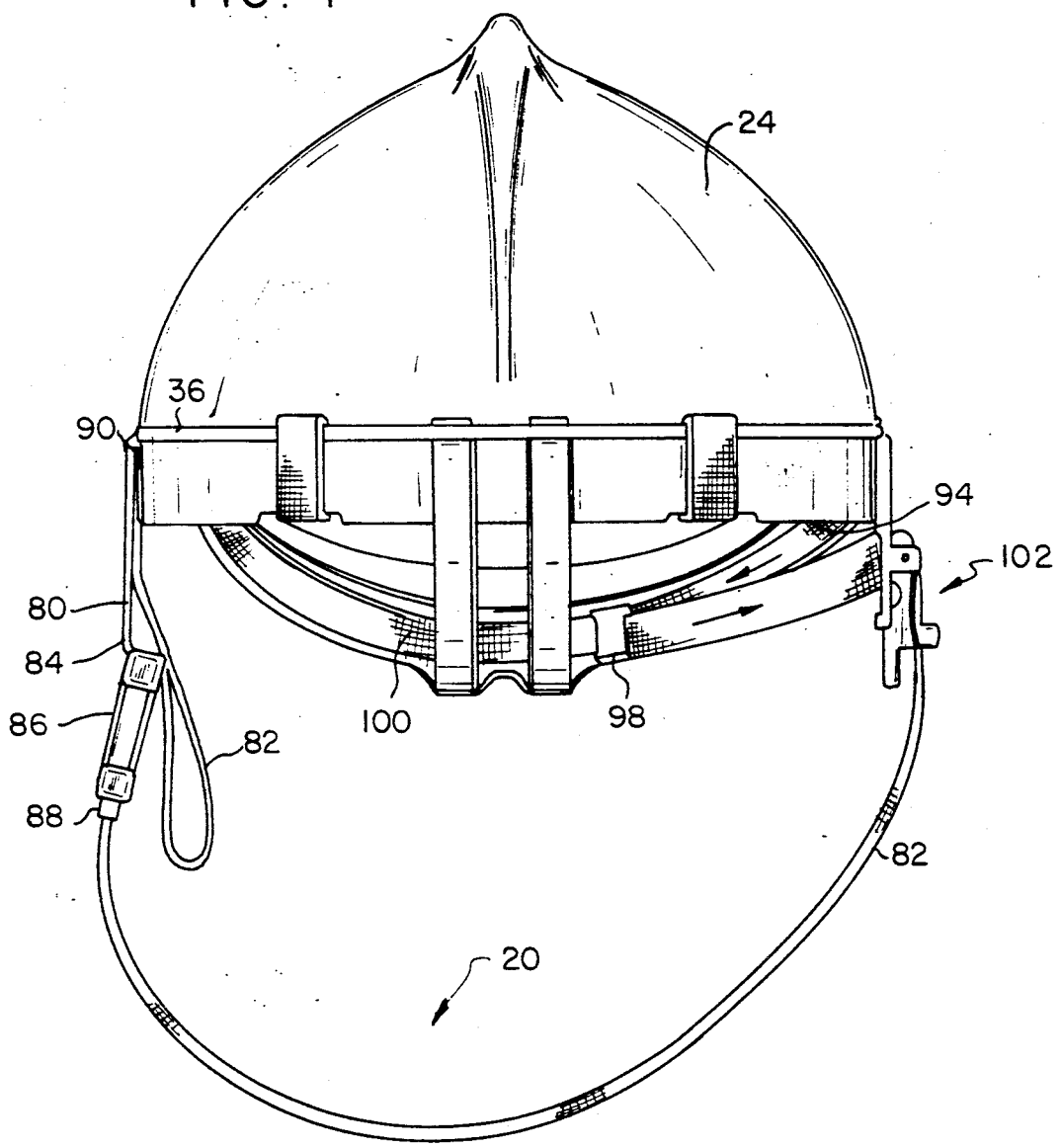
FIG. 4 is a rear view of the inner impact attenuation liner assembly.
Figure 5:
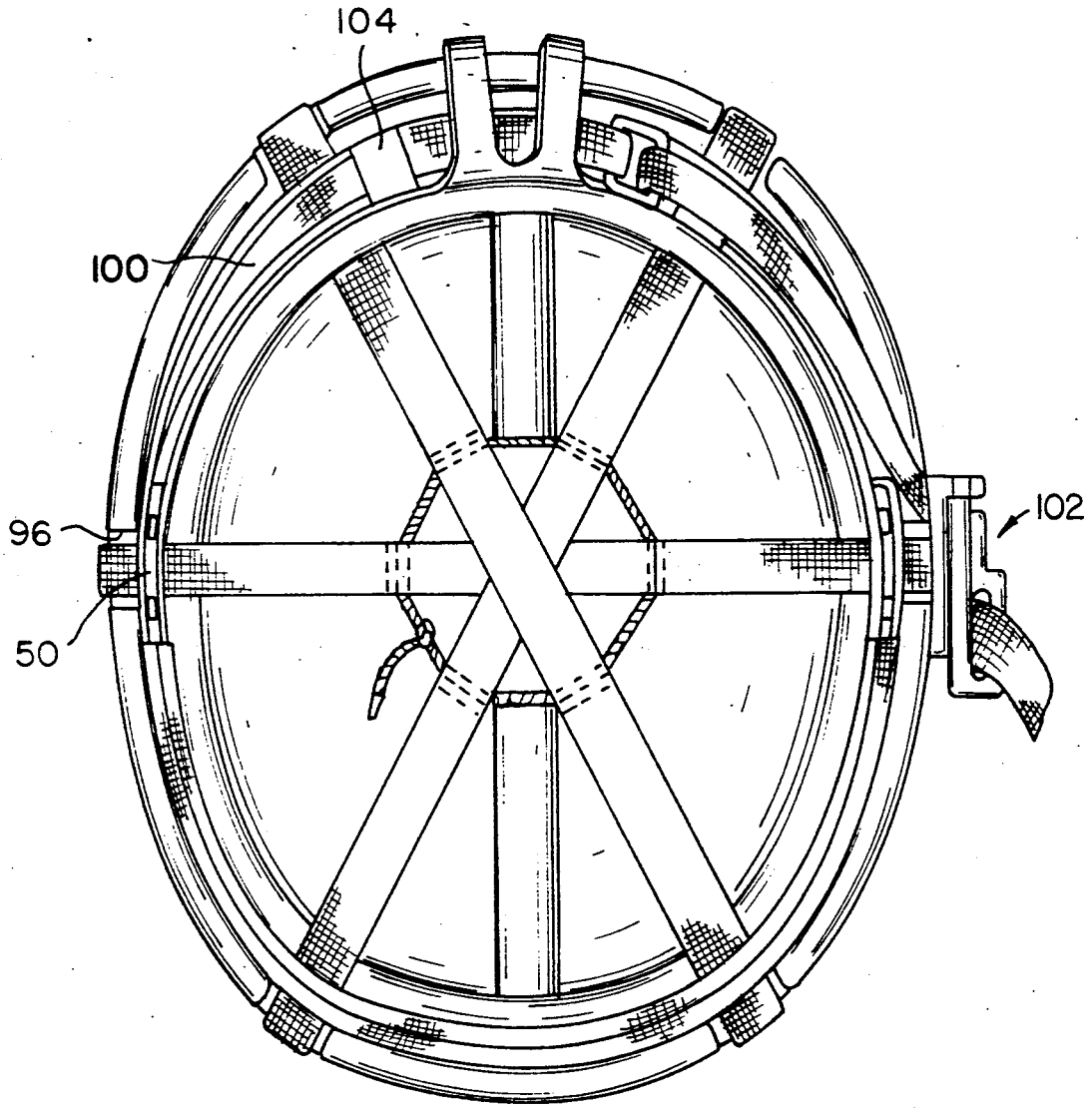
FIG. 5 is a bottom view of the inner impact attenuation liner assembly.

The chinstrap assembly 20, referring particularly to FIG. 4 is comprised of chinstrap members 80 and 82 formed of a strong webbing material, such as NOMEX® or nylon, with an end 84 of one strap member 80 provided with an engaging clip member 86 for affixing the chinstrap member 82 having a cooperating clip member 88 into the chinstrap assembly 20 for encircling about the user's jaw for closely engaging the user's chin. The chinstrap member 80 is mounted to the inner liner assembly 14, such as by the other ends 90 encircling the tube member 36 in a manner similar to the mounting of the straps 28. The chinstrap member 80 is formed with an inwardly extended free-end portion 92 to act as a barrier between the cooperating affixed clip members 86 and 88, and the face of the user.

An end 94 of the chinstrap member 82 remote from that portion having the clip member 88 is mounted by stitching (not shown) to an outer surface portion the plate member 50 opposite the chin strap member 80 and is coursed over an outer surface portion of the rear headband member 48 and through a ring member 98 mounted to a strap member 100 and thence returning to a locking clip member, generally indicated as 102 for adjustable fixation, as more fully hereinafter described. The strap member 100 is coursed through a positioning loop 104 and is mounted by a pin member 96 to the plate member 50 proximate the chinstrap member 80.

Figure 6:
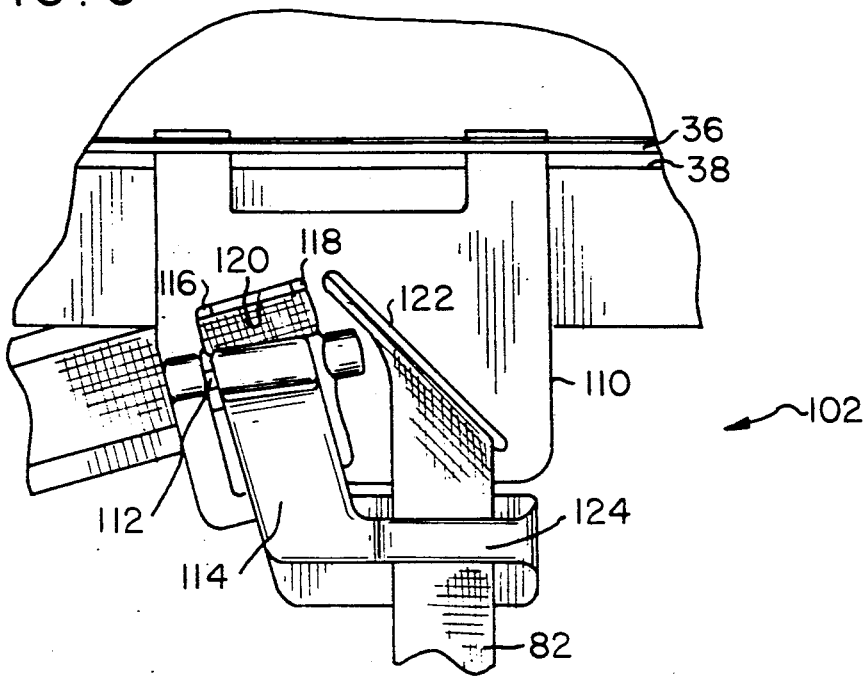
FIG. 6 is an enlarged elevational view of the clip assembly in engaged and locked position.
Figure 7:
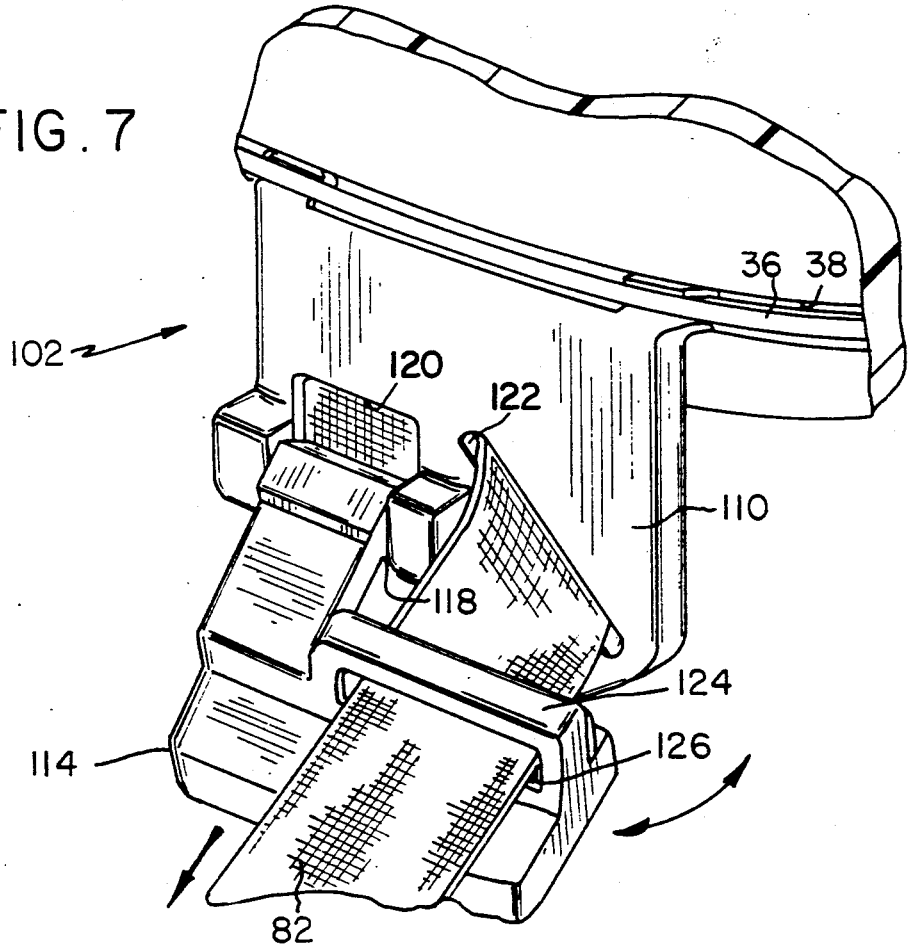
FIG. 7 is an enlarged isometric view of the clip assembly.

The clip member 102 referring more particularly to FIG. 6 and 7, is comprised of a plate member 110 to which is mounted for rotation, such as by a pin member 112 a locking element 114. The plate member 110 of the clip member 102 is mounted by upper end C-shaped portions 106 by the tube member 36 to the inner liner assembly member 14 in a vertically downwardly depending position essentially parallel to the longitudinal axis of the inner liner assembly member 14 referring to FIGS. 2 to 7. The plate member 110 is formed with parallely-disposed slots 116 and 118 defining an intermediate band portion 120 therebetween and a slot 122 formed at an angle of 45° to the slots 116 and 118. The strap member 82 is coursed through the slots 116, 118 and 122 respectively, starting from an inwardly approach to the slot 116 whereby the strap member 82 is thereupon disposed on an outer surface portion of the band portion 120 and thence inwardly through the slot 122 to emerge outwardly through the slot 118 and thereby to depend downwardly from the plate member 110.

The locking element 114 of the clip member 102 is formed with an enlarged portion 124 defining a loop 126 through which is coursed the downwardly depending strap member 82 and with a serrated section 128 proximate the channel 120. The pin member 112 permits rotation of the locking element 114 with respect to the plate member 110 in a plane parallel to the axis of the pin member 112 and perpendicular to the strap member 82 passing through the slots 116 and 118, as more fully hereinafter discussed.

As described and claimed in copending application U.S. Ser. No. 07/137,378, filed Dec. 23, 1987, incorporated herein by reference, the protective helmet assembly of the present invention may be provided with a releasable head retaining assembly permitting separation of the inner liner assembly 14 from the outer shell 12 under a predetermined load or shearing force.

In operations, the protective helmet assembly 10 of the present invention permits facile adjustment to particular size of the user's head over a wide range of potential user head size. Generally, a user may first adjust the front headband portion 46 in an open configuration of the rear headband portion 48, i.e. the chinstrap assembly 20 is not positioned about the neck of the user nor is the chinstrap member 82 under any tensioning force caused by the lock member 114 retaining the strap member 82 in a locked position. Initially, the user may adjust the side ends 62 of the front headband portion 46 with respect to the plurality of available positions afforded by the orifices 64 formed on the plate member 50. After appropriate selection of orifice 64 to pin 66 relationship, the tab member 56 including fastening material 58 separated from the cooperating fastening material 60 may be rotated vertically about the axis of the pins 66 in a direction illustrated by arrow "A" referring to FIG. 8.

After achieving a satisfactory relationship between the relative position of the front headband 46 to the foam liner 24, the fastening material 58 and 60 are forced together in locking interrelationship. Once the front headband member 46 is comfortably positioned, the user need only resort to essentially one step to adjustably position the inner liner assembly about the user's head. Once positioned on the user's head, the user need only pull outwards on the chinstrap member 82, referring to FIGS. 2, 3 and 7 with the locking element 114 extending horizontally outwardly from the plate member 110. Continued tensioning of the chinstrap 82 causes the rear headband member 48 to move forward along a fore and aft longitudinal axis of the helmet assembly 10 against the cooperative spring forces of the distended tab member 70 as illustrated by the arrow "B", again referring to FIG. 8.

Once comfortable, relative positioning of the rear headband portion to the head of the user is achieved, the chinstrap member 82 is caused to rotate downwardly by the user whereby the serrated portion 128 of the locking element 114 is caused to capture a portion of the strap member 82 disposed in the intermediate band portion 120 thereby locking further forward or backward movement of the strap member 82 thereby essentially rigidly affixing the protective helmet 10 on the user's head via the inner liner assembly 14. The chinstrap member 80 and 82 may be thereafter affixed about the chin of the user by the cooperating clip member 86 and 88.

The advantages of the present invention will be readily understood by one skilled in the art, particularly given the downwardly angularly position of the rear headband member 48 which permits capturing of the user's head at a point proximate to the nape of the user's neck, as distinquished from headband assemblies of the prior art which essentially fail to provide any head capturing capability but only provide a base for comfortably resting the protective helmet on the head with the chinstrap assembly providing the capturing ability.

The clip member 102 is preferably formed of a plastic material, and is of a dimension to permit repeated use under high levels of tension without breakage. It will be understood by one skilled in the art that the headband assembly may be comprised of a front headband member 46 essentially fixed within the inner liner assembly 14 yet providing for the capture of the head of the user by the rear headband member 48 as hereinabove described.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

What is claimed:

1. An inner liner assembly for a protective helmet assembly, which comprises:

an inner liner defining a head receiving cavity;

a front headband member mounted to said inner liner;

a rear headband member mounted to said inner liner for longitudinal movement with respect to said head receiving cavity;

a strap means engaging said rear headband member for effecting forward longitudinal movement thereof; and a clip means mounted to said inner liner for said strap means and having an opened position and a locked position, said strap means coursed through said clip means and manually operated by user for coursing said strap means through said clip means in said opened position thereof to effect forward longitudinal movement of said rear headband from an opened position to a forward position thereby capturing said user's head within said head receiving cavity, said clip means being moved to said locked position to fix said strap means therein thereby fixedly positioning said rear headband member with respect to said user's head in said head receiving cavity of said inner liner.

2. The inner liner assembly as defined in claim 1 wherein said rear headband member is mounted to said inner liner for movement from said forward position to said opened position.

3. The inner liner assembly as defined in claim 1 or 2 wherein said strap means for said headband member is comprised of first and second rear strap portions disposed on a side of said inner liner opposite said head receiving cavity, said first rear strap portion including a loop member, said second rear strap portion including a full end portion positioned through said loop member and coursed through said clip means for effecting forward longitudinal movement of said rear headband member.

4. The inner liner assembly as defined in claim 1 or 2 wherein said clip means is provided with a locking member for engaging said second strap position in a fixed position.

5. The inner liner assembly as defined in claim 4 wherein said clip means extends downwardly from said inner liner and said locking member is disposed for upward rotational movement from said fixed position to an opened position.

6. The inner liner assembly as defined in claim 1 or 2 wherein said front headband member is mounted for rotational movement about an axis traverse to said longitudinal axis of said inner liner.

7. The inner liner assembly as defined in claim 6 wherein said front headband member includes a tab portion extending along a longitudinal axis of said inner liner and is provided with a material cooperating with a material disposed on an inner surface of said inner liner to fix at a predetermined portion of said front headband member with respect to said inner liner.

8. The inner liner assembly as defined in claim 7 wherein said front headband member includes a plurality of positioning orifices on side portions thereof for affixing said side portions at preselect position with respect to said inner liner.

9. A protective helmet assembly, which comprises:

an outer shell defining an internal chamber;

a foam inner liner defining a head receiving cavity and disposed in said internal chamber of said outer shell;

a front headband member mounted to said foam inner liner;

a rear headband member mounted to said foam inner liner for longitudinal movement with respect to said head receiving cavity;

a strap means engaging said rear headband member for effecting forward longitudinal movement thereof; and a clip means mounted to said foam inner liner for said strap means, said strap means coursed through said clip means and manually operated by user for coursing said strap means through said clip means to effect forward longitudinal movement of said rear headband member from an opened position to a closed position for capturing said user's head within said head receiving cavity and to fix said strap means therein after positioning of said rear headband member with respect to said user's head.

10. The protective helmet assembly as defined in claim 9 wherein said rear headband is mounted to said foam inner liner for movement from said closed position to said opened position.

11. The protective helmet assembly as defined in claims 9 or 10 wherein said strap means for said rear headband member is comprised of first and second rear strap portions disposed on a side thereof opposite said head receiving cavity, said first rear strap portion including a loop member, said second rear strap portion including a full end portion positioned through said loop member and coursed through said clip means for effecting forward longitudinal movement of said rear headband member.

12. The protective helmet assembly as defined in claims 9 or 10 wherein said clip means is provided with a locking member for engaging said second strap portion in a fixed position.

13. The protective helmet assembly as defined in claim 12 wherein said clip means extends downwardly from said foam inner liner and said locking member is disposed for upward rotational movement from said fixed position to an opened position.

14. The protective helmet assembly as defined in claims 9 or 10 wherein said front headband member is mounted for rotational movement about an axis transverse to said longitudinal axis of said foam inner liner.

15. The protective helmet assembly as defined in claim 14 wherein said front headband member includes a tab portion extending along a longitudinal axis of said foam inner liner and is provided with a material cooperating with a material disposed on an inner surface of said foam inner liner to fix at a predetermined portion of said front headband member with respect to said foam inner liner.

16. The protective helmet assembly as defined in claim 15 wherein said front headband member includes a plurality of positioning orifices on side portions thereof for affixing said side portions at a pre-select position with respect to said foam inner liner.

* * * * *